United States Patent [19]

Russell

[11] Patent Number: 4,700,422

[45] Date of Patent: Oct. 20, 1987

[54] MULTIPLE USE DRAIN CLEANING APPARATUS

[76] Inventor: V. Lee Russell, 4440 NW. 11th Ter., Oklahoma City, Okla. 73107

[21] Appl. No.: 783,741

[22] Filed: Oct. 2, 1985

[51] Int. Cl.[4] ..... B08B 9/02

[52] U.S. Cl. ..... 15/104.3 SN; 134/103; 134/168 C

[58] Field of Search ..... 15/104.3 SN; 134/166 C, 134/167 C, 168 C, 169 C, 94, 95, 99, 103, 169 R, 169 A

[56] References Cited

U.S. PATENT DOCUMENTS

| | | | |
|---|---|---|---|
| 2,266,126 | 12/1941 | Malsbary et al. | 134/94 X |
| 3,025,547 | 3/1962 | Ciaccio | 15/104.3 |
| 3,048,870 | 8/1962 | Criscuolo | 15/104.3 SN |
| 3,162,878 | 12/1964 | Agostino | 15/104.3 SN |
| 3,370,599 | 2/1968 | Ciaccio | 15/104.3 SN X |
| 3,399,417 | 9/1968 | Hammond et al. | 15/104.3 SN |
| 3,983,593 | 10/1976 | Naeve | 15/104.3 SN |
| 4,312,679 | 1/1982 | Klein, Sr. | 134/8 |
| 4,364,139 | 12/1982 | Babb et al. | 15/104.3 SN |
| 4,368,757 | 1/1983 | Finger | 137/565 |
| 4,420,852 | 12/1983 | Bowlsby | 15/104.3 |

*Primary Examiner*—Philip R. Coe

*Attorney, Agent, or Firm*—Bill D. McCarthy

[57] ABSTRACT

A highly portable, multiple purpose drain cleaning apparatus comprising a payout drum supporting a snake hose wound thereon and supported for rotation on a portable support frame, a plurality of fluid tanks in selective fluid communication with a powered pump connected to the snake hose, and a nozzle attachment removably supported at the distal end of the snake hose. In one embodiment, with the snake hose wound in its storage mode thereon, the payout drum is quickly removable and replaceable with another payout drum containing a different diameter sized snake hose. Selective high pressure fluid jetting and/or cutting modes are available over a wide range of drain pipes and passage access through various trap sizes and short bends.

17 Claims, 12 Drawing Figures

MULTIPLE USE DRAIN CLEANING APPARATUS

BACKGROUND OF THE INVENTION

1. Field of the Invention

The present invention relates generally to improvements in drain cleaning apparatus, and more particularly, but not by way of limitation, to a portable drain cleaning apparatus having multiple combination usages for servicing a broad range of drain sizes and piping component combinations, including traps and short bends.

2. Discussion of Prior Art

Drain cleaning apparatus of various types and arrangements have been known for many years. Bowlsby, U.S. Pat. No. 4,420,852, teaches the use of a rotatable drum having a length of coiled spring snake with an internally extending flexible tube for carrying a flow of water to the free end of the snake. Tap water is passed at house pressure to the hub of the drum to which the near end of the snake is attached. However, this does not provide any practical cleaning efficacy, as the low pressures encountered in such service is simply ineffective to provide any practical benefit.

Sato, U.S. Pat. No. 3,959,840, is similar, but includes a pump which communicates with a water tank for delivering a high pressure water jet to the free end of the flexible tube.

Ciaccio, U.S. Pat. No. 3,025,547, is an earlier teaching of a wheel supported portable apparatus which deals with the matter of simultaneously feeding and rotatably driving a coiled rod with a cutting tool mounted thereon for cleaning municipal sewers, and with the imparting of variable rotating and payout speeds by means of power provided by a gasoline engine. Ciaccio, U.S. Pat. No. 3,370,599, also dealing with larger municipal sewers, teaches a similar rotatable drum and power apparatus but adds a rotary hydraulic cleaning tool incorporating a forwardly directed cleaning jet and rearwardly-directed propulsion jets to assist in propelling the tool along the sewer pipe.

Klein, Sr., U.S. Pat. No. 4,312,679, teaches a method for cleaning clogged pipes in which a snake hose having a free end nozzle with radially directed jets is forced through a clogged pipe area and withdrawn in flushing activation. The claimed purpose is to avoid dirty water backup in the pipe's internally positioned inlets.

Finger, U.S. Pat. No. 4,368,757, teaches a pressure cleaning apparatus having a pair of fluid containers used to blend detergent and water to the suction inlet of a pump. However this patent, being of interest in the general area of pressurized cleaning devices, does not deal with the cleaning of sewer lines and the like.

These and all other known prior art teachings have faced specific problems associated with the cleaning of municipal, industrial and domestic drainage lines. As discerned from the above mentioned patents, as well as from my long experience in the field of drainage cleaning, a fairly wide array of cleaning devices are available to the craftsman faced with a particular stoppage difficulty. However, when one is called to a location, he is usually informed only vaguely as to what is to be expected in terms of line sizes, trap types and locations, and other such information necessary to preequip himself for the cleaning task at hand. Thus, the normal service operator may find himself ill equipped to adapt his response in terms of equipment to the problem encountered. In short, drain cleaning apparatus which offer a wide range of systems that can be used in various combinations to accommodate and bring relief to a customer's plaintive but ill described request for assistance has attractive and useful possibilities in this field.

SUMMARY OF THE INVENTION

The present invention comprises a drain cleaning apparatus featuring a multiple use capability. A rotatable payout drum is supported by a wheeled frame which supports a power source for selectively rotating the payout drum in either rotational direction. A spring stiffened snake hose is wound on the payout drum which has a central hollow hub through which the snake hose is extendable and rotatable concentrically with the drum.

A pump assembly is supported on the frame, the pump assembly having a plurality of fluid tanks in fluid communication with a pump which is powered by the frame supported power source, the pump's outlet port communicating high pressure fluid to the snake hose.

The payout drum is supported for quick detachment and removal, for the purpose of mounting a substitute payout drum containing a different sized high pressure cable and blade attachment.

In one embodiment, a combination cutter blade and nozzle attachment is supported on the free end of the snake hose. Yet another embodiment features a combination nozzle and spring coil supported at the free end of the snake hose for easy admittance and passage through especially deep traps in the drainage line.

Another embodiment features a removable truck support assembly for a payout drum for independent use thereof at a remote site without need for the main frame and power source.

It is an object of the present invention to provide an improved drain cleaning apparatus having multiple use cleaning capability for a wide range of drain pipes and the like.

Another object of the present invention is to provide an improved drain cleaning apparatus which affords maximum capability within the service limits of that required for commercial and domestic drain cleaning and the like.

A further object is to provide an improved drain cleaning apparatus which offers wide flexibility of servicing capability while enjoying economy of manufacturing, operating and maintenance costs.

Other objects, advantages and features of the present invention will be apparent from the following description when read in conjunction with the accompanying drawings and appended claims.

BRIEF DESCRIPTION OF THE DRAWINGS

In the accompanying drawings, which form part of the instant specification and which are to be read in conjunction therewith, and in which like reference numerals are used to indicate like parts of the various views:

FIG. 8A shows a semi-detailed cutaway view of a deep drainage trap with the snake hose having the cutter blade attachment of FIG. 5 extending therethrough.

DESCRIPTION

Figure 1:
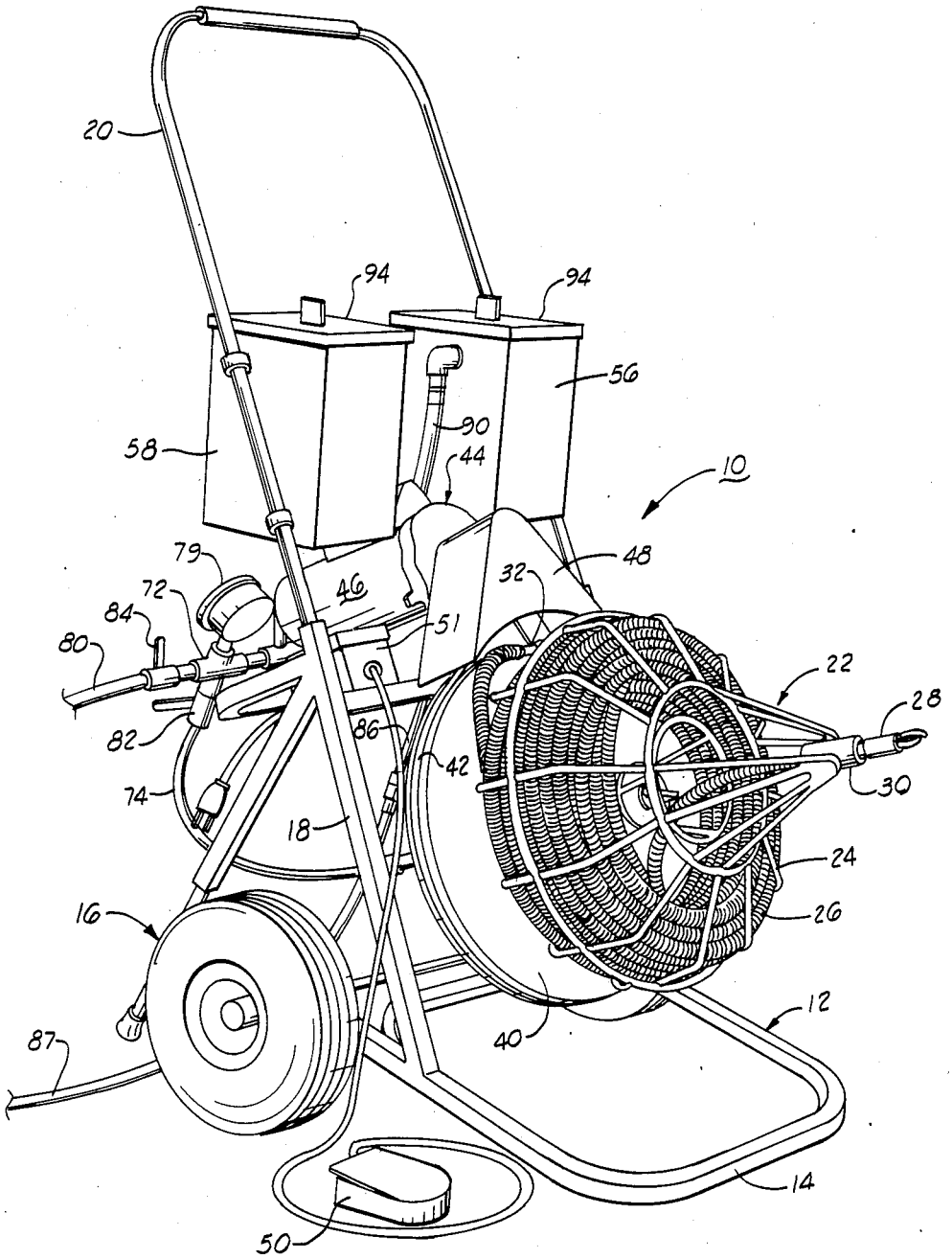
FIG. 1 is a front side perspective view of a drain cleaning apparatus made in accordance with the present invention.
Figure 2:
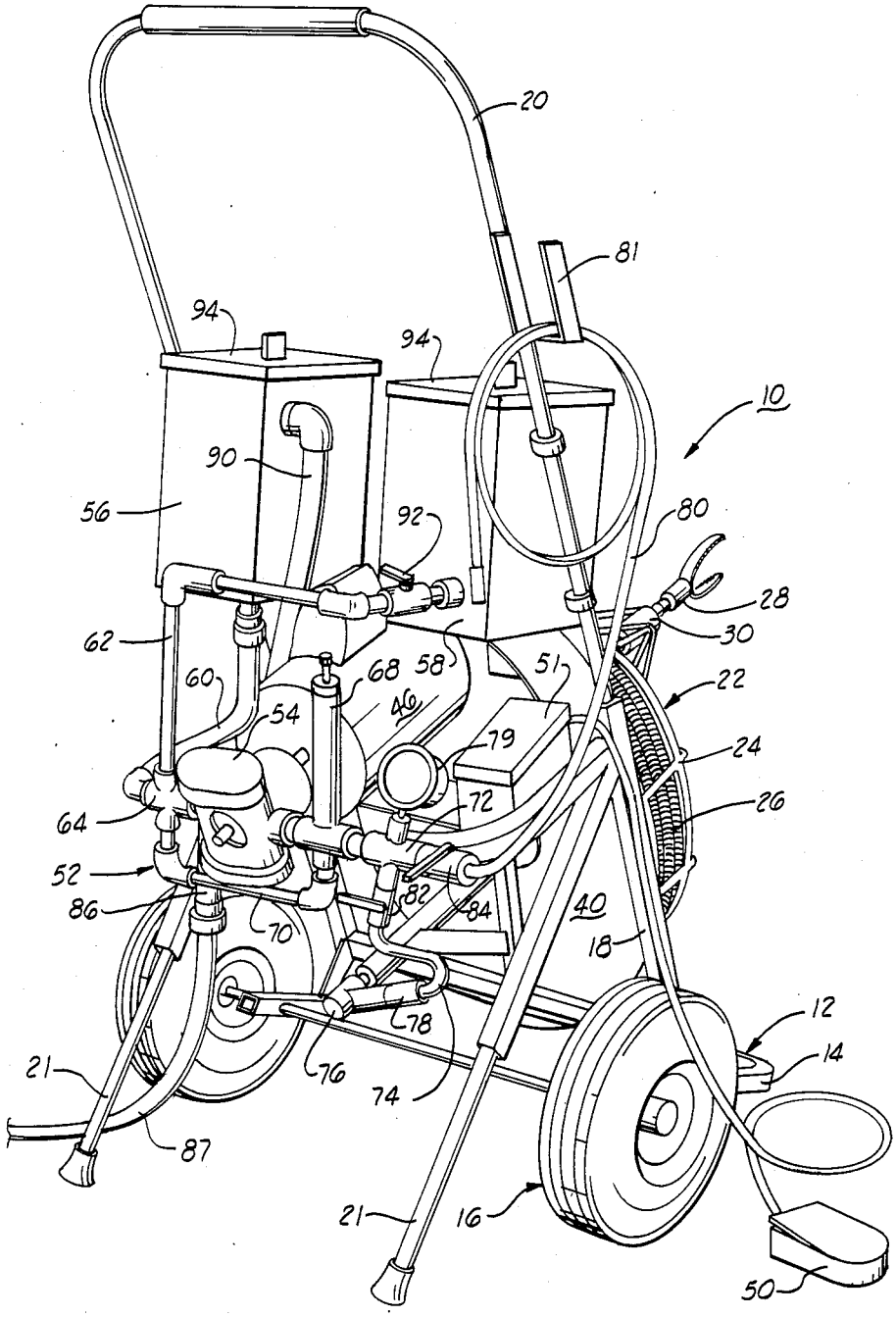
FIG. 2 is a rear side perspective view of the drain cleaning apparatus of FIG. 1.

Referring to the drawings in general, and more particularly to FIG. 1 and 2, shown therein is a drain cleaning apparatus 10 constructed in accordance with the present invention. The drain cleaning apparatus 10 comprises a main frame assembly 12 having a generally horizontally extending bar frame 14 which supports a dual wheel assembly 16 and a pair of upwardly extending bar members 18. A handle member 20, angularly disposed for tilting the main frame assembly 12 to place the weight thereof on the wheel assembly 16, is connected between the upper end portions of the bar members 18. Cross braces are provided in the main frame assembly 12 as necessary for strength and rigidity thereof. Also, a pair of stabilizing members 21 are attached to the bar members 18 and are adjustably extendable to stabilize the main frame assembly 12 when parked in a working position; appropriately disposed set screws (not shown) serve to lock the extendable portions in a desired extension. The stabilizing members are retractable when frame tilt is desired during movement of the frame assembly 12.

A drum assembly 22 is supported on the main frame assembly 12, the drum assembly 22 comprising a generally cylindrically shaped cage or payout drum 24. As will be appreciated, drum assemblies of the type shown are well known in the art, and need not be described in detail except to note that the cage 24 is supported on a rotatable drive shaft 25 (the end of which being viewable in FIG. 3) which is supported by appropriately disposed bearings mounted on the main frame 12. The drive shaft 25 is a partially hollow arbor of conventional design to accommodate fluid passage for the purpose described hereinbelow. A snake hose 26 is wound up within the cage 24 in its storage mode, with the free end 28 of the snake hose 26 being extendable through a central hollow hub 30 of the drum assembly 22 and concentrically rotatable therewith. The innermost end (not shown) of the snake hose 26 is connected to a stationary, conventional quick connect and conduit assembly 32 which is attached to the rotatable drive shaft 25 in a manner which provides fluid communication to the snake hose 26 with the hollow portion of the drive shaft 25.

Figure 3:
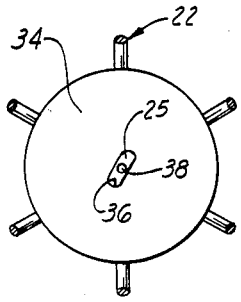
FIG. 3 is a plan view of the attachment hub of the payout drum of the drain cleaning apparatus of FIG. 1.

A brief referral to FIG. 3 shows an end view of the drive shaft 25 and a central attachment plate 34 of the drum assembly 22. The attachment plate 34 has an aperture 36 shaped to fit over the outer, flattened end of the drive shaft 25, which has a threaded bore 38 therein. A male attaching bolt (which is omitted in the interest of drawing clarity) is threadingly engaged in the bore 38 to firmly secure the drum assembly 22 to the drive shaft 25 for rotation therewith. Also, the drum assembly 22 is easily removable from the drive shaft by disconnecting the innermost end of the snake hose 26 and removing the male attaching bolt, leaving the drive shaft 25 free to receive another drum assembly having a different size or type of snake hose wound thereon. As best shown in FIGS. 1 and 2, a drive wheel 40 is mounted on the drive shaft 25, and a drive belt 42 extends thereover.

Mounted on a appropriately located cross brace of the main frame assembly 12 is a power assembly 44. In the embodiment shown in FIGS. 1 and 2, the power assembly 44 comprises an electric motor 46 and a power sheave (not shown) for receiving the drive belt 42 for imparting rotational power to the drive wheel 40. A protective guard 48 is preferably provided over the power sheave and the upper portion of the drive belt 42. Conventional electrical switching and relay controls are provided, and may include a foot operated switch 50. Also, a ground fault interrupter 51 is provided to lessen the danger of electrical shock in the event of an electrical short circuit condition. If desired, auxiliary power outlets (not shown) can be provided, such as in the box which houses the ground fault interrupter 51.

The drain cleaning apparatus 10 also has a powered pump assembly 52 supported on the main frame 12 and comprising a pump 54 which is also connected to the electric motor 46 for power rotation thereby. This is made possible because of the double ended drive shaft of the electric motor 46. While such double shaft drives are shown, the portability of the drain cleaning apparatus 10 is enhanced by the compactness provided thereby. While such motors are used elsewhere, it is believed that the use of a double drive electric motor as used in drain cleaning machines such as described herein is unique.

Figure 4:
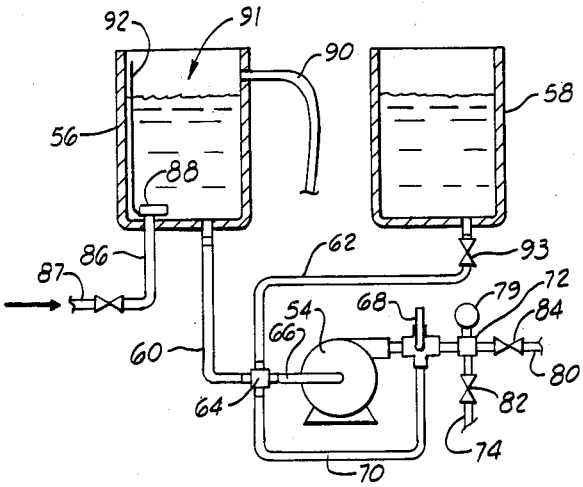
FIG. 4 is a semi-detailed schematic of the pump asembly of the drain cleaning apparatus of FIG. 1.

The pump assembly 52 is shown in FIG. 2 and also schematically in FIG. 4. A pair of fluid tanks 56 and 58 are mounted on the inside of the handle member 20 via conventional brackets, and are interconnected to the pump 54 via conduits 60 and 62 which join at a cross-fitting 64. A conduit 66 communicates the cross-fitting 64 to the suction port of the pump 54. The outlet port of pump 54 communicates with a regulating unloader valve 68 which in turn communicates with a bypass conduit 70 connected to the cross-fitting 64. The unloader valve 68 is of conventional design and bypasses or recycles pump flow to the low pressure side of the pump 54 via bypass conduit 70 when the discharge pressure exceeds a predetermined pressure setting. The unloader valve 68 passes high pressure pump outlet fluid to a cross-fitting 72, which itself is connected to a conduit 74. The conduit 74 is connected to the drive shaft 25 via a conventional rotational connector coupling 76, thus connecting the high pressure fluid from the pump 54 to the snake hose 26 in the drum assembly 22. Preferably, a quick connect coupling 78 is provided to connect the conduit 74 to the rotational connector coupling 76 so that the conduit 74 is quickly disconnectable for a reason discussed hereinbelow.

The cross-fitting 72, provided with a visual indicating pressure gage 79, also communciates with a spray hose 80, only a portion of which is shown in FIGS. 1 and 2 in the interest of simplifying the drawing for clarity of other details. A conventional hand-held spray nozzle can be provided at the free end of the spray hose 80, and a conventional storage bracket 81 (FIG. 2) is provided to support the spray hose 80 in its wound up, storage mode on one side of the handle 20. Manual valves 82 and 84 are provided in the conduits 74 and 80, respectively, for the selective routing of high pressure fluid from pump 54 to the conduit 74 or to the spray hose 80.

The first fluid tank 56 serves as a water reservior. An inlet conduit 86 is connectable to a water source, such as by a hose 87 which is connectable to a hydrant, and an anti-siphon valve 88, such as is conventionally used in reservior tanks for water closets, assures a demand water flow to the first fluid tank 56. An overflow conduit 90 is connected to the first fluid tank 56 as shown, leaving an air gap 91 above the fluid level in the tank 56. The anti-siphon valve 88 has a small rubber conduit 92 which is supported by a conventional clip along an inner wall of the tank 56 so that its distal end extends into the air gap 91 above the connecting point of the overflow conduit 90, thus breaking the siphoning possibility of the hose 87 in order to protect the portable water supply. The second fluid tank 58 serves as a reservoir for a chemical additive, such as detergent, grease emulsifier, or any one of many chemicals which may be required for a particular application. A manual flow control valve 93, such as a conventional metering valve, is provided in conduit 62, and a drain valve (not shown) may be provided if desired. Also, lids 94 can be provided for the tanks 56 and 58.

Figure 5:
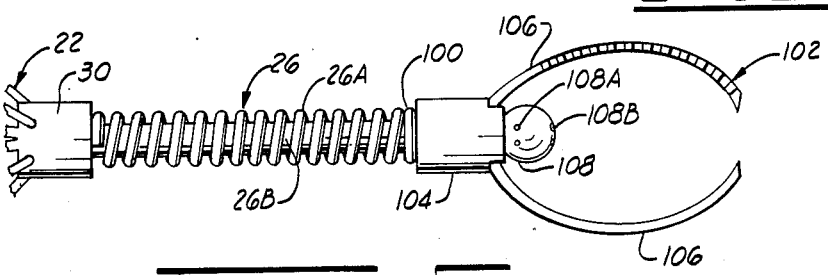
FIG. 5 is a side elevational view of a cutter blade attachment supported on the free end of a snake hose supported on the payout drum of the drain cleaning apparatus of FIG. 1.

Turning now to FIG. 5, shown therein is the free end 100 of the snake hose 26 extending from the hollow hub 30 of the drum assembly 22. As depicted therein the snake hose 26 comprises a cable member 26A which has an inner high pressure hose 26B extending the length thereof. The cable member 26A is an open wind cable wire which is sized to afford good flexibility to the snake hose 26. That is, the cable member 26A is determined to have sufficient stiffness to impart rotation from the drum assembly 22 to a cutter blade and nozzle assembly, while at the same time, it is sufficiently flexible as to easily bend back over itself, such as, for example, by tying a length thereof into a knot by manual pressure along and to again be extended without permanent distortion.

Attached to the free end 100 of the snake hose 26 is a cutter blade and nozzle assembly 102. A cable end terminal member 104 is swaged onto the free end 100 and has a threaded post (not shown) which extends through a central aperture in an accurately shaped cutter member 106, and a nozzle 108, having an internally threaded bore, serves as a nut to secure the cutter member 106 to the threaded post of the cable end terminal member 104. The nozzle 108 can have any desired arrangement of apertures to effect any selected jet spray pattern in fluid operation. In FIG. 5, the nozzle 108 has a pair of side apertures 108A on opposing sides thereof to effect radial jetting against the wall of a drain pipe, and it also has one or more forward apertures 108B that serve to effect forwardly directed jetting. The aperatures 108A, 108B have fluid communication with the hose 26B and serve to form a jetting spray as the snake hose 26 is pressured via pump 54 and rotated via the rotating drum assembly 22. The combined jetting and cutting of the cutter blade and nozzle assembly 102 serves to clear a blocked area in the drain pipe into which the snake hose 26 is extended.

In operation, the drain cleaning apparatus 10 provides a portable unit which can be wheeled to a site providing access to a drainage line to be cleaned. A single operator can effect selective rotation of the drum assembly 22 via activation of electric motor 46 by the foot switch 50 as the operator manually pulls the snake hose 26 from the drum assembly 22 and feeds same into the drain line. The operator can activate fluid jetting by opening the valve 82 with the pump 54 activated by the electric motor 46. The snake hose 26 is then moved forward to clear the blockage. When the drain line is cleared, the snake hose 26 is retrieved as the drum assembly 22 is rotated and the snake hose 26 is placed in its wound up, storage mode onto the drum assembly 22.

Figure 6:
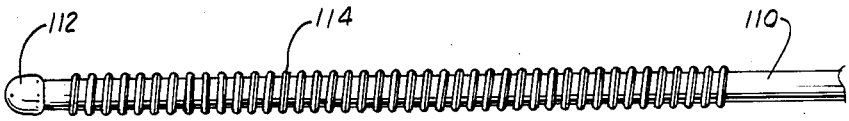
FIG. 6 shows the spring stiffened free end of a jetting hose.
Figure 7:
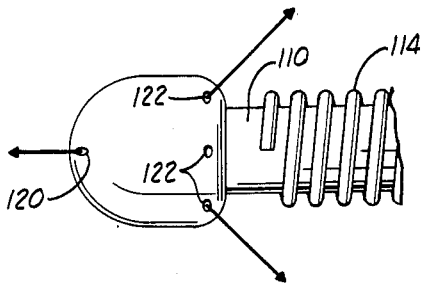
FIG. 7 is an enlarged view of the nozzle end of the hose shown in FIG. 6.

FIG. 6 shows a more flexible hose 110 which has a nozzle 112 attached to its free end. The nozzle 112 is shown in enlarged view in FIG. 7. For some traps, such as very deep, cast iron P-traps, it is difficult, if not impossible, to pass a cutter blade attachment therethrough. Also, a cutter blade is not always required to clear blockage in a drain line, as many soft blockages, such as grease, only require the high pressure jetting action of a nozzle/hose arrangement. However, experience has shown that a flexible hose along will not pass through some very deep P-traps. Accordingly, the hose 110 has been provided with an overwound flexible spring 114 which extends over the free end thereof for a length of about 24 to 30 inches. While the stiffness of the spring 114 is not critical, the spring 114 should permit that portion of the free end of the hose 110 which is covered thereby to fold back easily over itself, thus permitting ease of sharp turning within a P-trap or a short bend.

Figure 8:
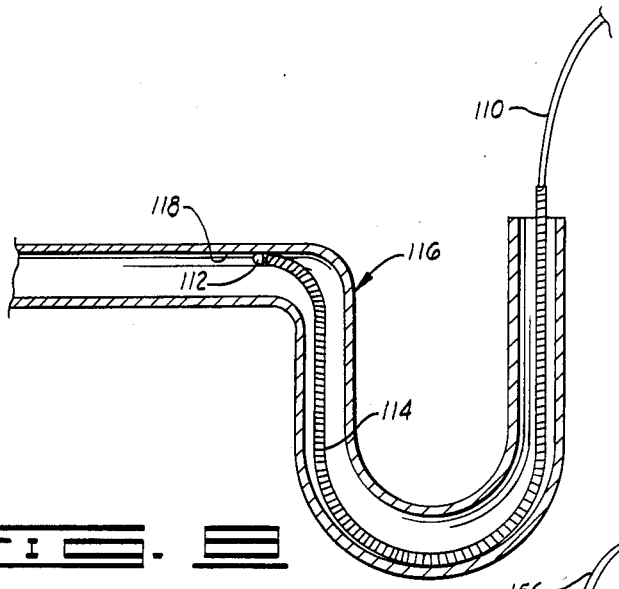
FIG. 8 shows a semi-detailed, cutaway view of a deep drainage trap with the jetting hose of FIG. 6 extending therethrough.

A deep P-trap is shown in cross-sectional view in FIG. 8 and is therein designated by the numeral 116, while a normal trap 116A is depicted diagrammatically in FIG. 8A, described below. In FIG. 8 the hose 110 is shown in the position whereat it has just passed through the final bend in the trap, and the flexible spring 114 has permitted ready bending while preventing the nozzle 112 from being stopped as it strikes the wall of drain pipe 118. It is believed that the reason that bare hoses often will not pass through such deep traps is that they lack sufficient stiffness to impart the pushing force of the operator to the nozzle end once it jams the wall 118, while the flexible spring 114 serves to transfer this pushing force to the nozzle while preventing hose folding in the trap. The choice of location of the jet apertures in any particular nozzle will vary according to the spray pattern required for a particular cleaning application. For example, radially disposed jet apertures may be desirable, such as with the stiffer snake hose 26 described hereinabove.

In FIG. 8A, the snake hose 26 is shown as it has passed through the trap 16A, and having its nozzle assembly 102 advanced into the drain line 118A toward a blockage 119. While nozzle assemblies having cutter blades (much like nozzle assembly 102 and cutter members 106) are known in the prior art, it is believed that the present invention is the first to provide access to drain pipes through traps and other like sharp turns using such nozzle assemblies as depicted in FIG. 8A. While it is not clearly understood why the snake hose 26 (and the other snake hose 110 with spring 114) is passable through very sharp bends when such is contrary to the experience of the present inventor and others, it is believed that the open spring cable surrounding the inner hose of the snake hose 26 affords a much more flexible snake hose and is the reason thereof. Success has been good with cutters ranging from one and one-half inches up to six inches depending upon the size of line being cleaned.

Returning to FIG. 7, it will be noted that the nozzle 112 has a plurality of jet apertures from which pressurized fluid from the hose 110 is jetted. A forward aperture 120 serves to cut any blockage that is encountered in the drain line, while peripherally disposed apertures 122 serve to effect a rearwardly directed jet spray which serves to push the nozzle along the drain line and assist in pulling the hose into drain cleaning position, as well as serving to backwash cleared material as the hose 110 is pulled from the drainage pipe.

While the spring 114 is described as being only a short segment as depicted in FIG. 6, it has been found that certain small diameter hoses are best wound with the spring 114 for substantially the full length of the hose. This additional spring length serves to prevent hose kinking, or over push as the hose 110 is pushed into a drain line. Generally, such entire hose overlapping of the flexible spring 114 is only necessary for especially small and highly flexible hose sizes.

Figure 9:
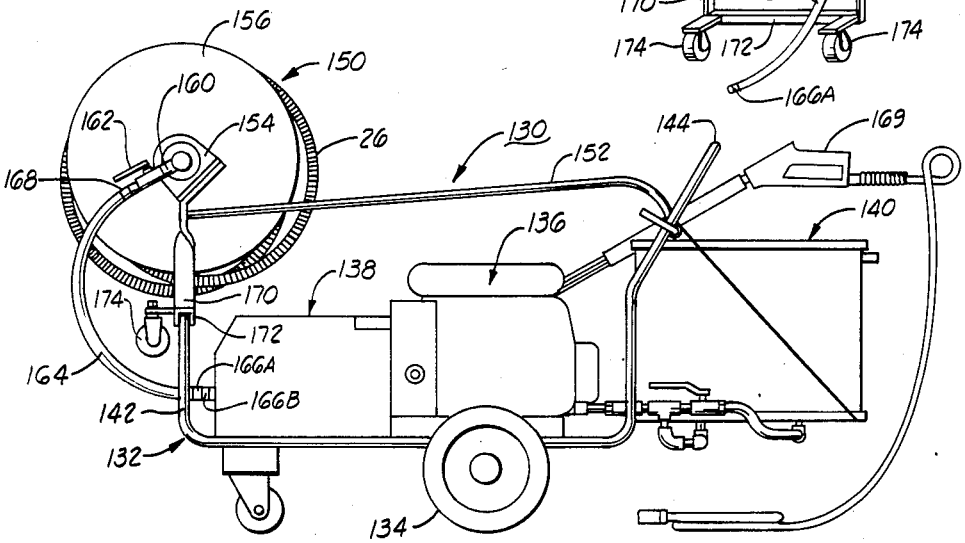
FIG. 9 is a side elevational view of another embodiment of the drain cleaning apparatus of the present invention.
Figure 10A:
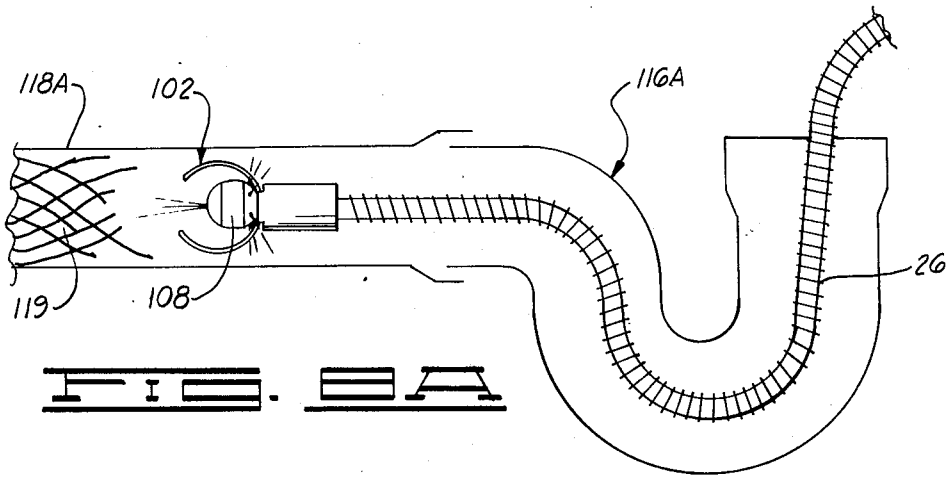

Another embodiment of the drain cleaning apparatus of the present invention is shown in FIG. 9 and designated by the numeral 130. The drain cleaning apparatus 130 has a main frame assembly 132 which includes a plurality of generally horizontal bar frame members supported by a wheel assembly 134. Supported on the main frame assembly 132 are a gasoline powered engine assembly 136 and a pump assembly 138. The pump assembly 138 includes a two compartment fluid tank assembly 140 and appropriate piping and valving. It will not be necessary for the present disclosure to describe certain details of the drain cleaning apparatus 130 in depth as these are very similar, if not identical to those described hereinabove for the drain cleaning apparatus 10. These omitted details include a description of the pump components and the piping details of the pump assembly 138, as well as the inner construction details of the dual compartment, fluid tank assembly 140.

Further, it will be noted that the main frame assembly 132 has upwardly extending bar members 142 at the forward end thereof, and upwardly extending bar members 144 that form a handle member at the rear end of the frame. A truck support assembly 150 extends over, and is supported by, the bar members 142 and bar members 144. The truck support assembly 150 is a subunit which is removable from the main frame assembly 132 and useable as separated therefrom in the manner depicted in FIG. 10.

The truck support assembly 150 comprises a pair of parallel frame members 152 that attach to opposite ends of an arbor assembly 154 on which a payout drum or reel 156 is rotatably mounted via appropriately disposed bearings. A foldable handle member 158 is provided on one side of the drum 156 for manual turning of the drum on the arbor assembly 154. The arbor assembly 154 includes a partially hollow shaft to which a rotational connector coupling 160 is attached. A valve 162 and conduit 164 communicate with the connector coupling 160, with the distal end of the conduit 164 having one half of a quick connect coupling 166A attached thereto; the other half of the quick connect coupling 166B communicates with the outlet port of the pump assembly 138. The conduit 164 can be connected to the valve 162 via a quick connect coupling 168, if desired, for a purpose described hereinbelow.

A snake hose 26 or flexible hose 110 of the type and of the description provided hereinabove for the drain cleaning apparatus 10 is wound onto the drum 156, in its storage mode, and has its near end attached to, and in fluid communication with, the hollow shaft of the arbor assembly 154. Also, the drain cleaning apparatus 130 can be equipped with a hand-held spray nozzle unit 169 if desired.

Attached to the frame member 152 are parallel frame members 170 that are disposed along opposing ends of the drum 156, and a cradle member 172 is attached therebetween. A pair of caster wheels 174 are supported by the cradle member 172, and the cradle member 172 is nestable on the bar members 142 (on a cross member extending therebetween) in the manner depicted in FIG. 9, and the distal ends 176, curved to form hand grips, are supported on inwardly protruding frame rests members (not shown) on the bar members 144. With the drum assembly 150 supported on the main frame assembly 132 as depicted in FIG. 9, the conduit 164 is connected to the pump outlet port via interconnection of the quick connect coupling halves 166A, 166B.

Figure 10:
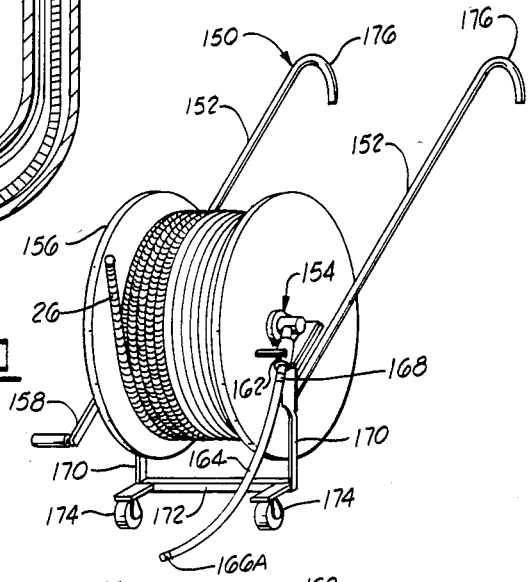
FIG. 10 is an isometric view of the truck support assembly with the payout drum removed from the drain cleaning apparatus of FIG. 9.

In one mode of operation, the hose of the truck support assembly 150 is hand fed into a drainage line to be cleaned, and once started into the line, with the fluid tank assembly 140 having been connected to an available water supply, the pump assembly 138 is activated by starting the engine 136 and opening the appropriate valves. Another mode of operation is the use of the truck support assembly 150 after it is removed from the main frame assembly 132, as shown in FIG. 10, wherein the truck support assembly 150 can be hand wheeled to a work site, and connected to a source of pressurized water directly. This latter mentioned mode of operation fits those occasions where only a jetting snake hose is required for the job application. For example, the truck support assembly 150 can be wheeled to a location separated from the main frame assembly 132, and interconnected to the pump assembly 138 via an appropriately pressure rated extension hose (not shown).

Figure 11:
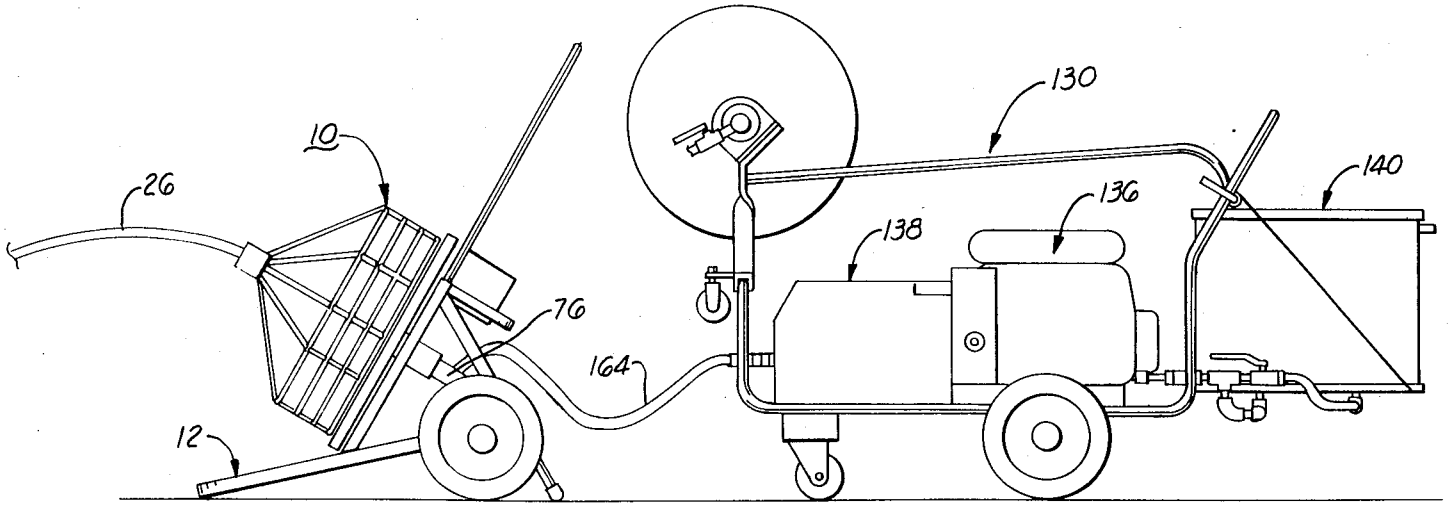
FIG. 11 is a semi-detailed diagrammatical depiction of tandem connection of a pair of alternative embodiments of the present invention.

The portability capability of the present invention limits the size of the electric motor that can be supplied with the drain cleaning apparatus 10; that is, it is desirable that the electric motor 46 be operable on standard 110–115 voltage outlets commonly available at most domestic and commercial sites. This is not usually a limitation of concern, as the pressure available from pump assemblies powered by such motors is quite adequate for most cleaning jobs. It will be recognized that these limitations are not applicable to the drain cleaning apparatus 130 which incorporates a gasoline powered engine 136, and higher pressure ranges can therefore be achieved. It is within the contemplation of the present invention to couple the capability of the drain cleaning apparatus 130 to that of the drain cleaning apparatus 10. With these units in tandem positions, as depicted in FIG. 11, the units are interconnected by connecting a pressure hose (such as hose 164) equipped with appropriate quick connect coupling members between the pump assembly 138 of the drain cleaning apparatus 130 and the drive shaft 25 of the drain cleaning apparatus 10 via the rotational connector coupling 76. This permits the higher fluid pressures generated by the drain cleaning apparatus 130 to be transmitted to the snake hose 26 of the drain cleaning apparatus 10, which can be used in the manner described above to clean a drainage line.

In such tandem arrangement, it will be necessary to supply fluid to the pump 54 (from tank 56) in order to prevent this pump from running dry. The bypass unloader valve 68 and bypass conduit 70 will simply assure continuous and proper pump operation during the time that the drain cleaning apparatus 10 is in fluid receiving connection with the drain cleaning apparatus 130. Alternatively, it may be preferable to disconnect the pump 54 from the electric motor 46, or for extended tandem use, to remove the pump 54 and replace the electric motor 46 with a single drive motor.

The present invention, as discussed above, presents a drain cleaning apparatus having a multiple use capability. Each of the embodiments hereinabove described is designed to use water from any available water hydrant, thereby eliminating the necessity to transport water to the job site. The water and chemical solution passing through the pump provides a source of high pressure, low volume fluid. This is ideal for clearing stoppages in drains and sewers since only small quantities of fluids can be injected in such lines before fluid backup is experienced. That is, the size of such lines make the use of a low quantity, high pressure fluid desirable. Further, this lesser quantities of fluid is advantageous for chemical injection because a more economical quantity of the injected chemical is used due to less dilution by the water injected; this is in contrast to the presently known high volume jet machines that are designed for municipal and industrial usage. That is, the present invention, due to its exceptionally good economy of fluid management, permits the usage of certain chemicals, such as grease neutralizers, that previously were too expensive to use in residential or light commercial applications due to the amounts previously required to achieve an acceptable degree of cleaning effectiveness. These grease neutralizers, such as that sold under the trademark Jet Power by Jet Vac Sanitary Services, Inc. of New Smyrna Beach, Fla., are formulated to work with high pressure water. Chemically treated grease will not re-solidify, and it has been observed that chronic grease stoppages that were being cleared once a week remained clear for up to three months after being treated with high pressure water and chemical. The present invention makes this benefit economical and thus available for smaller users of such drain cleaning services.

Finally, the featured improvements of the present invention provides the capability of mechanically cleaning drains and sewers through previously inaccessible traps and with high pressure water and chemical solutions.

It is clear tha the present invention is well adapted to carry out the objects and to attain the ends and advantages mentioned herein, as well as those inherent in the invention. While presently preferred embodiments of the invention have been described for purposes of this disclosure, numerous changes can be made which will readily suggest themselves to those skilled in the art and which are encompassed within the spirit of the invention disclosed and as defined in the appended claims.

What is claimed is:

1. A multiple use drain cleaning apparatus for cleaning a drain pipe, comprising:

a frame assembly having a plurality of frame members and a wheel assembly supporting the frame members;

a drum assembly supported by the frame assembly comprising a payout drum, a rotatable drive shaft, and a truck support assembly, the payout drum supported by the drive shaft, the truck support assembly supporting the payout drum and supportable by the frame assembly and selectively removable therefrom, the truck support assembly having a wheel assembly and frame members forming handle portions so that the truck support assembly is usable to support the payout drum separated from the frame assembly;

a snake hose supported by the payout drum, the hose having a near end attached to the rotatable drive shaft and a free end with a nozzle extendable into the drain line;

pump means for pressurizing and communicating a fluid to the hose for discharge by the nozzle at the free end of the snake hose, the pump means comprising a pump supported by the frame assembly, the pump having an inlet port and an outlet port;

fluid means for supplying multiple fluids to dispense;

conduit means for communicating the fluids in selective proportions to the pump inlet port; and power means supported by the frame assembly for selectively driving the pump.

2. The dain cleaning apparatus of claim 1 wherein the snake hose has a flexible spring supported about the free end of the hose for a selected length therealong.

3. The drain cleaning apparatus of claim 2 wherein the pump assembly further comprises:

valve means communicating with the outlet port and with the inlet port of the pump for recycling fuid from pump outlet to the pump inlet when the outlet pressure of the pump exceeds a predetermined pressure.

4. The drain cleaning apparatus of claim 3 wherein the power means comprises a gasoline powered engine.

5. The drain cleaning apparatus of claim 4 wherein the nozzle at the free end of the snake hose has at least one forward directed jet aperture and a plurality of rearwardly directed jet apertures disposed such that hose propulsion in the drain line is effected.

6. The drain cleaning apparatus of claim 5 wherein the payout drum has a handle member disposed for manual rotation of the payout drum.

7. The drain cleaning apparatus of claim 1 wherein the payout drum is removably supported by the drive shaft and replaceable with various sizes of similarly constructed payout drums.

8. The drain cleaning apparatus of claim 7 wherein the payout drum has a central hollow hub and the snake hose is a spring stiffened snake hose the free end of which is extendable through the central hollow hub and which is rotatable concentrically with the payout drum to impart rotation to the free end as it is passed through the drain pipe, and wherein the power means is further characterized a selectively rotating the drive shaft and the payout drum attached thereto.

9. The drain cleaning apparatus of claim 8 further comprising:

cutter means supported on the free end of the snake hose for rotatably cutting through a blockage in the drain pipe as the snake hose is rotated and passed through the drain pipe.

10. The drain cleaning apparatus of claim 9 wherein the power means comprises an electric motor.

11. A multiple use drain cleaning apparatus for cleaning a drain pipe, comprising:

a frame assembly;

a drum assembly comprising a payout drum and a drive shaft rotatably supportd by the frame assembly, the payout drum removably supported by the drive shaft for rotation therewith and replaceable with various sizes of similar payout drums;

a snake hose supported by the payout drum, the payout drum having a central hollow hub through which a free end of the snake hose is extendable and rotatable concentrically with the payout drum, the snake hose comprising a hose, a flexible spring supported about the hose at the free end of the hose and a jetting nozzle member attached to its free end;

power means for selectively rotating the drive shaft and the payout drum supported thereby; and pump means for pressurizing and communicating a fluid to the hose for discharge by the nozzle member, the hose having a near end attached for quick disconnect to the rotatable drive shaft of the drum assembly, the power means further characterized as selectively powering the pump means.

12. The drain cleaning apparatus of claim 11 wherein the frame assembly comprises a plurality of frame members and wheel means for supporting the frame members.

13. The drain cleaning apparatus of claim 12 wherein the pump means comprises:

a pump having an inlet port and an outlet port;

a plurality of fluid tanks supported by the frame assembly;

conduit means for connecting one of the fluid tanks to a supply of water;

conduit means for connecting the fluid tanks to the inlet port of the pump;

means communicating with the outlet port and with the inlet port of the pump for recycling fluid from the outlet port to the inlet port when the outlet pressure of the pump exceeds a predetermined pressure; and means for selectively communicating fluid from the outlet port of the pump to the near end of the hose.

14. The drain cleaning apparatus of claim 13 further comprising:

a cutter blade supported by the free end of the hose so as to be disposed substantially adjacent the jetting nozzle, the cutter blade and jetting nozzle adapted to provide rotational cutting and fluid jetting when the hose is extended into the drain pipe.

15. The drain cleaning apparatus of claim 14 wherein the nozzle at the free end of the hose has at least one forward directed jet aperture and a plurality rearwardly directed jet apertures angularly disposed such that hose propulsion in the drain line is effected.

16. The drain cleaning apparatus of claim 13 wherein the power means comprises an electric motor.

17. The drain cleaning apparatus of claim 13 wherein the power means comprises a gasoline powered engine.

* * * * *

UNITED STATES PATENT AND TRADEMARK OFFICE

CERTIFICATE OF CORRECTION

PATENT NO. : 4,700,422

DATED : October 20, 1987

INVENTOR(S) : V. Lee Russell

It is certified that error appears in the above-identified patent and that said Letters Patent is hereby corrected as shown below:

In column 9, line 54, the word "tha" should read --that--. In column 10, line 26, the word "dain" should read --drain--; in column 10, line 32 "fuid" should read --fluid--.

Signed and Sealed this

Third Day of May, 1988

*Attest:*

*Attesting Officer*

DONALD J. QUIGG

*Commissioner of Patents and Trademarks*